US007024855B2

(12) United States Patent
Perrin et al.

(10) Patent No.: US 7,024,855 B2
(45) Date of Patent: Apr. 11, 2006

(54) VARIABLE GEOMETRY TURBOCHARGER WITH SLIDING PISTON

(75) Inventors: Jean-Luc Hubert Perrin, Thaon-les-Vosges (FR); Olivier Espasa, Thaon-les-Vosges (FR); Marylene Ruffinoni, Thaon-les-Vosges (FR); Alain Lombard, Thaon-les-Vosges (FR); Philippe Joseph Muller, Thaon-les-Vosges (FR)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 10/415,356

(22) PCT Filed: Nov. 30, 2000

(86) PCT No.: PCT/FR00/03350

§ 371 (c)(1),
(2), (4) Date: Apr. 28, 2003

(87) PCT Pub. No.: WO02/44527

PCT Pub. Date: Jun. 6, 2002

(65) Prior Publication Data

US 2004/0025504 A1 Feb. 12, 2004

(51) Int. Cl.
*F02D 23/00* (2006.01)
*F01D 17/14* (2006.01)
*F04B 17/00* (2006.01)

(52) U.S. Cl. ..... 60/602; 415/158; 415/150; 415/165; 417/407

(58) Field of Classification Search ..... 417/407; 60/602; 415/157, 158, 160, 165, 166
See application file for complete search history.

(56) References Cited

U.S. PATENT DOCUMENTS

| | | | | |
|---|---|---|---|---|
| 2,431,398 | A | 11/1947 | Hasbrouck | 415/157 |
| 2,874,642 | A | 2/1959 | Forrest | |
| 3,079,127 | A | 2/1963 | Rowlett et al. | |
| 4,419,046 | A | 12/1983 | Carlini | |
| 4,499,732 | A | 2/1985 | Szczupak et al. | |
| 4,557,665 | A | 12/1985 | Szczupak | |
| 4,586,336 | A | 5/1986 | Horler | 60/602 |
| 5,214,920 | A | 6/1993 | Leavesley | 415/158 |
| 5,231,831 | A | 8/1993 | Leavesley | 415/158 |
| 5,441,383 | A | 8/1995 | Dale et al. | 415/158 |
| 5,758,500 | A * | 6/1998 | Sumser et al. | 60/602 |
| 5,947,681 | A | 9/1999 | Rochford | 415/164 |
| 6,158,956 | A * | 12/2000 | Arnold | 415/158 |
| 6,715,288 | B1 * | 4/2004 | Engels et al. | 60/602 |
| 2003/0194333 | A1 * | 10/2003 | Sumser et al. | 417/407 |
| 2004/0244372 | A1 * | 12/2004 | Leavesley | 60/602 |

FOREIGN PATENT DOCUMENTS

| | | | | |
|---|---|---|---|---|
| DE | 43 03 520 | | 9/1994 | |
| EP | 34915 | A1 * | 9/1981 | 415/158 |
| EP | 0 678 657 | | 10/1995 | 60/602 |
| FR | 1 054 895 | | 2/1954 | |

* cited by examiner

*Primary Examiner*—Thai-Ba Trieu
(74) *Attorney, Agent, or Firm*—Chris James

(57) ABSTRACT

A turbocharger having a variable geometry turbine inlet incorporates a piston movable to vary the area of the inlet nozzle into the turbine. Vanes extending from the heat shield for flow control in the nozzle are engaged by the piston in a first closed position. In a second open position, the piston is spaced from the vanes increasing the inlet nozzle area.

5 Claims, 4 Drawing Sheets

VARIABLE GEOMETRY TURBOCHARGER WITH SLIDING PISTON

BACKGROUND OF THE INVENTION

1. Field of the Invention

The present invention relates generally to variable geometry turbochargers. More particularly, a turbocharger is provided having a sliding piston creating a variable nozzle turbine inlet with vanes extending across the nozzle in a closed position of the piston.

2. Description of the Related Art

High efficiency turbochargers employ variable geometry systems for turbine nozzle inlets to increase performance and aerodynamic efficiency. Variable geometry systems for turbochargers have typically been of two types; rotating vane and piston. The rotating vane type exemplified by U.S. Pat. No. 5,947,681 entitled PRESSURE BALANCED DUAL AXLE VARIABLE NOZZLE TURBOCHARGER provide a plurality of individual vanes placed in the turbine inlet nozzle which are rotatable to decrease or increase nozzle area and flow volume. The piston type, which is exemplified by U.S. Pat. Nos. 5,214,920 and 5,231,831 both entitled TURBOCHARGER APPARATUS, and U.S. Pat. No. 5,441,383 entitled VARIABLE EXHAUST DRIVEN TURBOCHARGERS, employs a cylindrical piston or wall which is movable concentric with the axis of rotation of the turbine to reduce the area of the nozzle inlet. In most cases, the piston type variable geometry turbocharger incorporates vanes with fixed angle of attack with respect to the airflow, which are either mounted to the piston or a stationary nozzle wall opposite the piston and are received in slots in the opposing surface during motion of the piston.

In piston type variable geometry turbochargers in the prior art, the challenge has been maximizing aerodynamic performance balanced with tolerancing of mating surfaces, particularly of vanes and receiving slots that are employed in most designs which are subjected to extreme temperature variation and mechanical stress, as well as providing means for actuating the piston in a readily manufacturable configuration.

SUMMARY OF THE INVENTION

A turbocharger incorporating the present invention has a case having a turbine housing receiving exhaust gas from an exhaust manifold of an internal combustion engine at an inlet and having an exhaust outlet, a compressor housing having an air inlet and a first volute, and a center housing intermediate the turbine housing and compressor housing. A turbine wheel is carried within the turbine housing for extracting energy from the exhaust gas. The turbine wheel is connected to a shaft extending from the turbine housing through a shaft bore in the center housing and the turbine wheel has a substantially full back disc and multiple blades. A bearing carried in the shaft bore of the center housing supports the shaft for rotational motion and a compressor impeller is connected to the shaft opposite the turbine wheel and enclosed within the compressor housing.

A substantially cylindrical piston is concentric to the turbine wheel and movable parallel to an axis of rotation of the turbine wheel. A plurality of vanes extend substantially parallel to the axis of rotation from a heat shield which is engaged at its outer circumference between the turbine housing and center housing and extends radially inward toward the axis of rotation. An actuator is provided for moving the piston from a first position proximate the heat shield to a second position is distal the heat shield. In the first position, a radial surface of the piston engages the end of the vanes. In the second position, the piston is spaced from the vanes creating a larger cross section nozzle with partial flow of exhaust gas from the turbine volute through the vanes and partial flow through an open annulus directly into the turbine.

BRIEF DESCRIPTION OF THE DRAWINGS

The details and features of the present invention will be more clearly understood with respect to the detailed description and drawings in which.

DETAILED DESCRIPTION OF THE INVENTION

Figure 1:
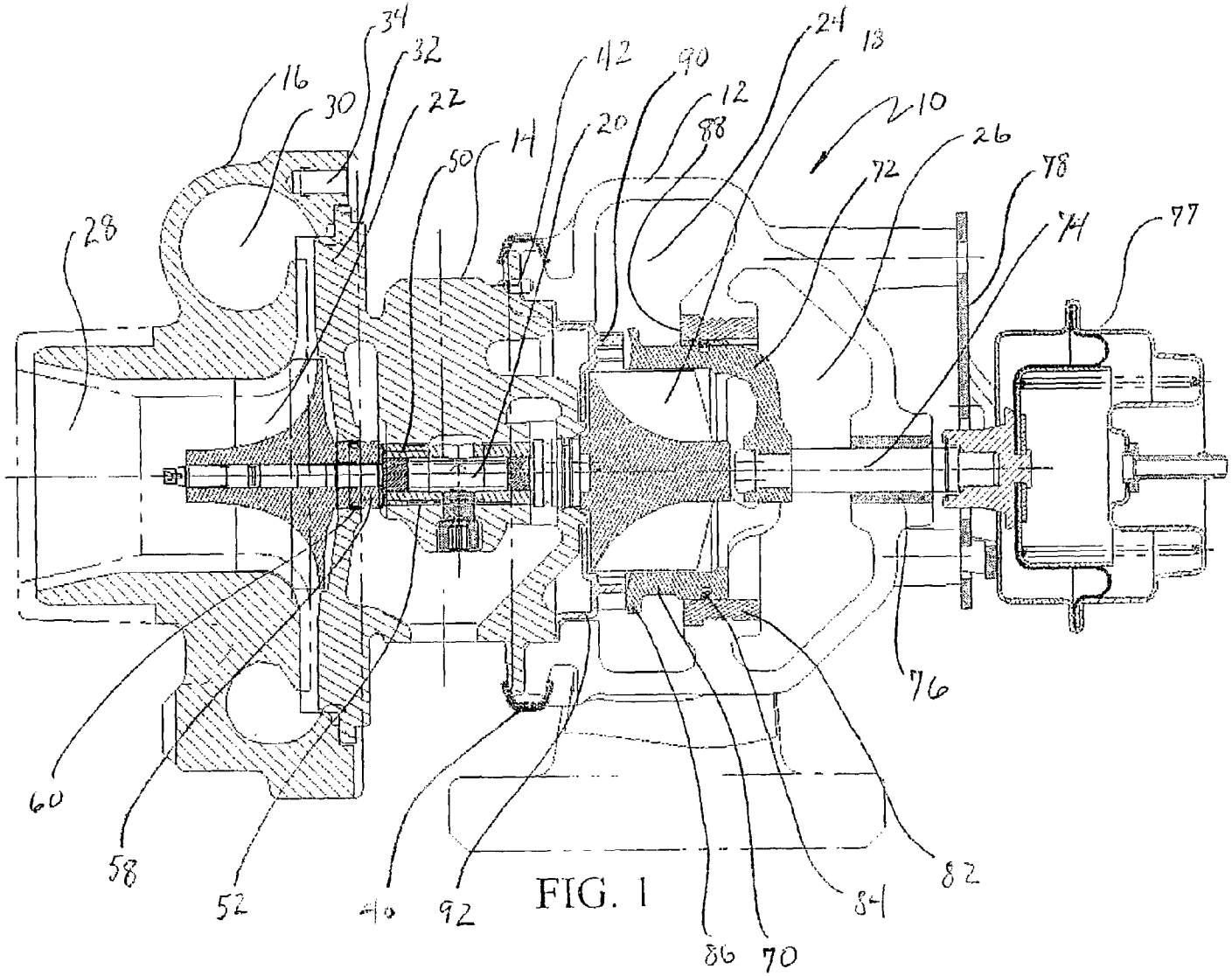
FIG. 1 is a cross-section elevation view of a turbocharger employing an embodiment of the invention with the piston in the closed position.

Referring to the drawings, FIG. 1 shows an embodiment of the invention for a turbocharger 10 which incorporates a turbine housing 12, a center housing 14 and a compressor housing 16. Turbine wheel 18 is connected through shaft 20 to compressor wheel 22. The turbine wheel converts energy from the exhaust gas of an internal combustion engine provided from an exhaust manifold (not shown) to a volute 24 in the turbine housing. The exhaust gas is expanded through the turbine and exits the turbine housing through outlet 26.

The compressor housing incorporates an inlet 28 and an outlet volute 30. A backplate 32 is connected by bolts 34 to the compressor housing. The backplate is, in turn, secured to the center housing using bolts (not shown) or cast as an integral portion of the center housing. A V-band clamp 40 and alignment pins 42 connect the turbine housing to the center housing.

A bearing 50 mounted in the shaft bore 52 of the center housing rotationally support the shaft. A sleeve 58 is engaged intermediate the thrust surface and compressor wheel. A rotating seal 60, such as a piston ring, provides a seal between the sleeve and backplate.

The variable geometry mechanism for the present invention includes a substantially cylindrical piston 70 received within the turbine housing concentrically aligned with the rotational axis of the turbine. The substantially cylindrical piston 70 is longitudinally movable by a spider 72, having three legs in the embodiment shown, attaching to the substantially cylindrical piston 70 and attaching to an actuating shaft 74. The actuating shaft 74 is received in a bushing 76 extending through the turbine housing and connects to an actuator 77. For the embodiment shown, the actuator is mounted to standoffs on the turbine housing using a bracket 78.

The piston slides in the turbine housing through a low friction insert 82. A cylindrical seal 84 is inserted between the piston and insert. The piston is movable from a closed position shown in FIG. 1, substantially reducing the area of the inlet nozzle to the turbine from the volute 24, to a fully open position shown on FIG. 2. In the fully open position, a radial projection 86 on the piston is received against an insert face or second wall 88 that limits the travel of the piston. As clearly shown in FIG. 2, the radial projection 86 extends to a larger radius than the generally cylindrical outer surface of the piston that is received in the low friction insert 82.

Nozzle vanes 90 extend from a heat shield or first wall 92. In the closed position of the piston (FIG. 1), the vanes are engaged by the free end face of the radial projection 86 on the piston. The heat shield outer periphery is engaged between the turbine housing and center housing. The shield is contoured to extend into the cavity of the turbine housing from the interface between the center housing and turbine housing and provide an inner or first wall for the turbine inlet nozzle. The vanes 90 extend partway across the axial width of the nozzle defined between the first wall or heat shield 92 and the second wall or insert face 88.

Figure 2:
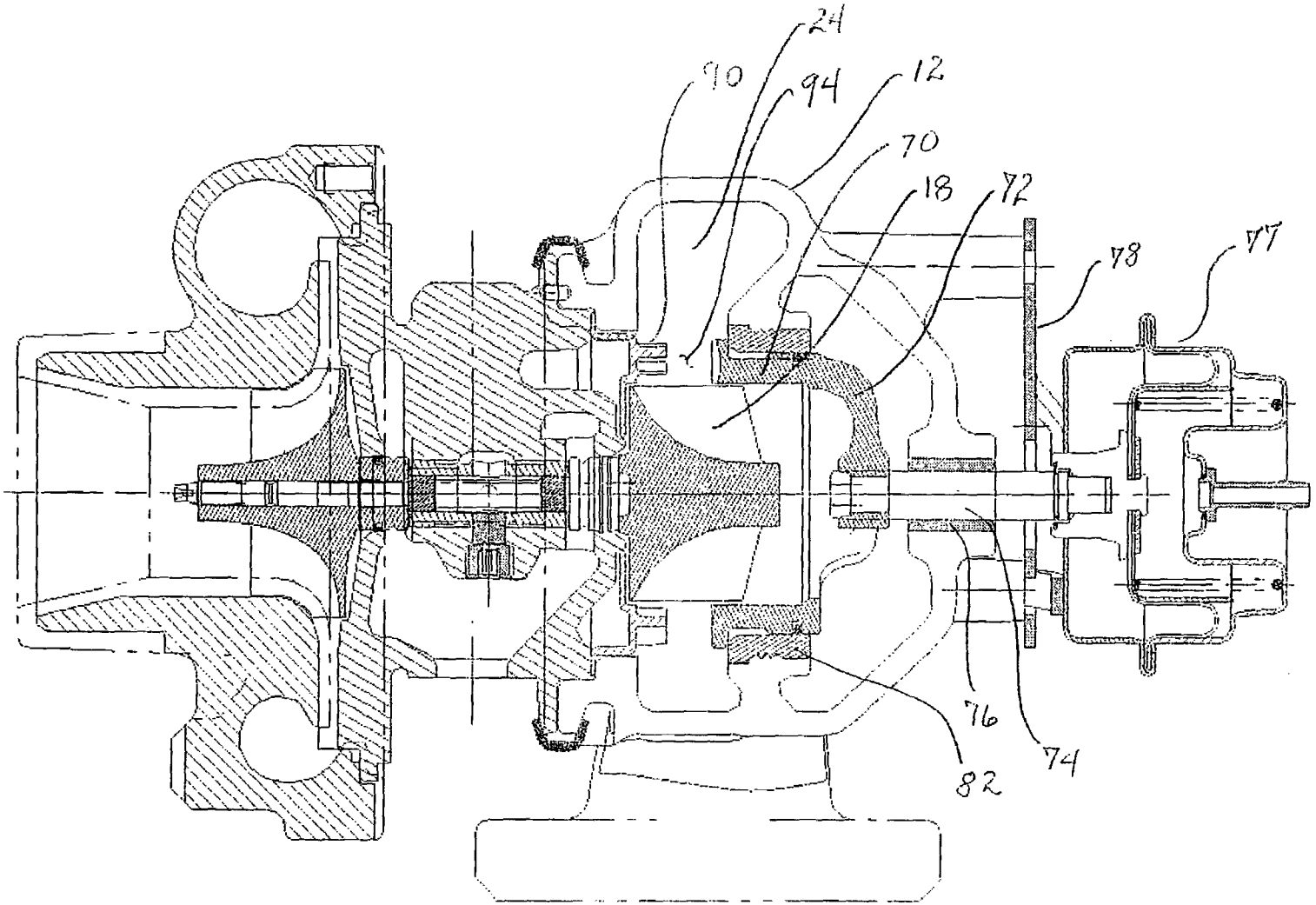
FIG. 2 a cross-section elevation view of the turbocharger of FIG. 1 with the piston in the open position.

FIG. 2 shows the turbocharger of FIG. 1 with the piston 70 in the open position. An open annular channel 94 is created intermediate the free ends of the vanes and the free end face of the radial projection 86. Exhaust gas flow through the vanes and annular channel which comprises the open nozzle is directionally stabilized by the vanes. Modulation of the nozzle flow can be accomplished by positioning the piston at desired points between the fully open and fully closed positions.

The actuation system for the piston in the embodiment shown in the drawings, is a pnuematic actuator 77 attached to bracket 78 as shown in FIGS. 1 and 2.

Figure 3:
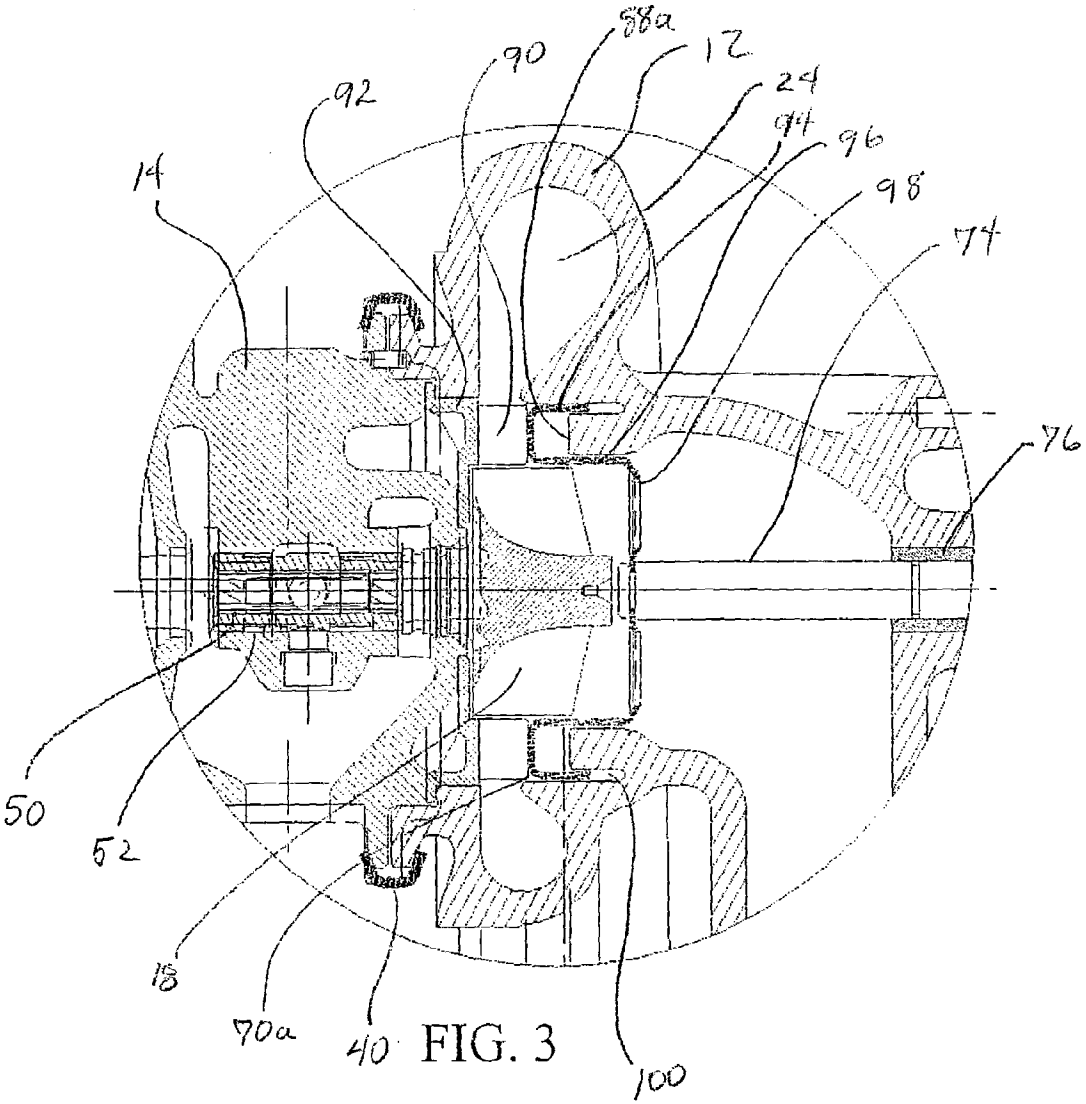
FIG. 3 is a cross section partial elevation view of a second embodiment of the invention with a staggered joint seal for the piston, with the piston in the closed position.

FIG. 3 shows a second embodiment of the invention incorporating a piston 70*a* which is fabricated from sheet metal or a thin wall casting having a substantially U-shaped cross section to incorporate an outer ring 94 parallel to the direction of translation of the piston 70*a* and an inner ring 96 extending to attach to a plate 98 for connection to the actuating shaft 74. The outer ring of the piston 70*a* is received in a slot 100 in the turbine housing and the inner ring is closely received by the inner circumferential wall of the turbine housing outlet thereby creating a staggered joint seal for the piston 70*a*. In the closed position, the web of the U-shaped piston 70*a* engages the vanes to create the minimum area nozzle.

Figure 4:
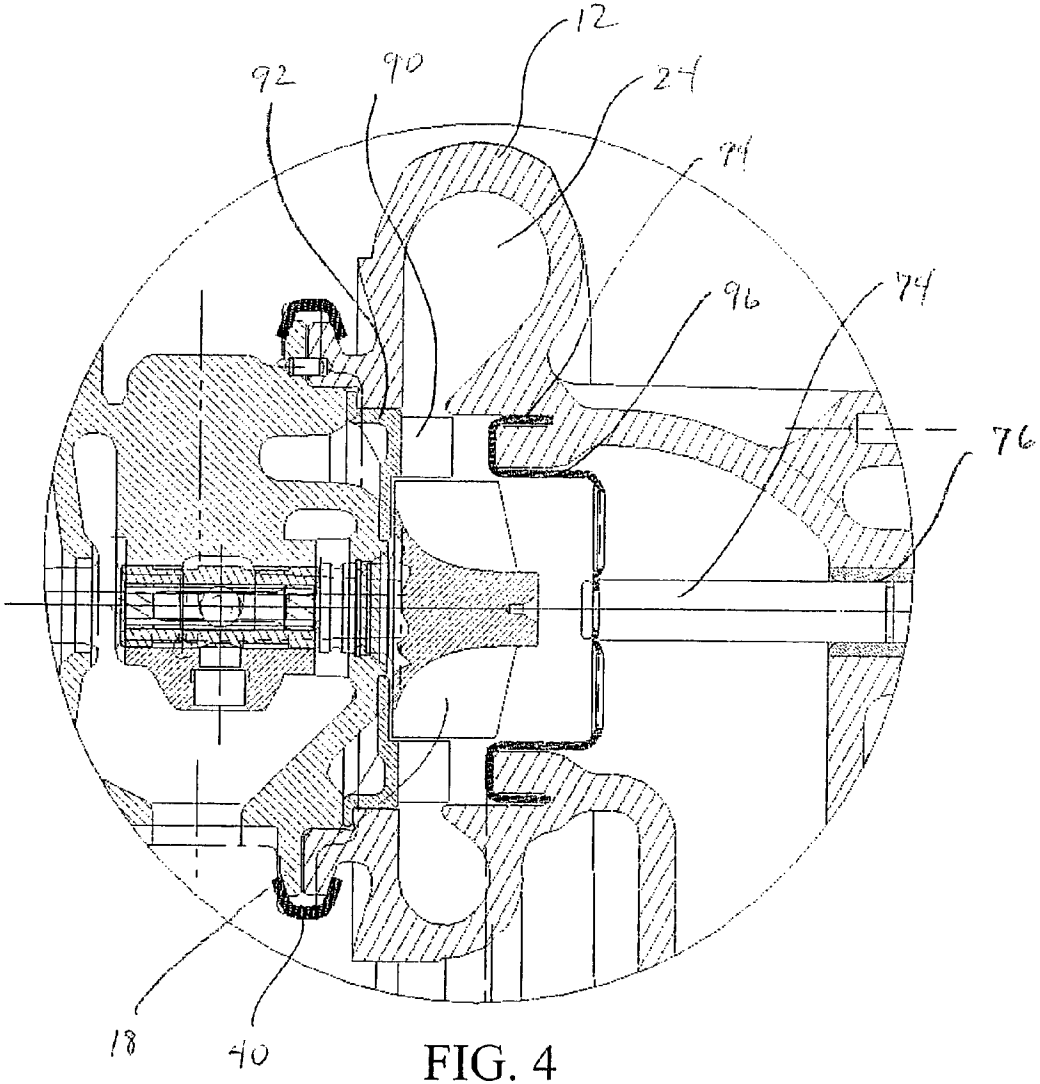
FIG. 4 is a cross section partial elevation view of the embodiment of FIG. 3 with the piston in the open position.

FIG. 4 shows the embodiment of FIG. 3 with the piston in the open position, and the web of the piston separated from the vanes providing the clear annular space previously described for the open nozzle providing maximum nozzle inlet area. Engagement of the rim of outer ring 94 with the end of the slot 100 or alternatively, engagement of the web of the U with the adjacent face 88*a* of the turbine housing limits the travel of the piston.

Having now described the invention in detail as required by the patent statutes, those skilled in the art will recognize modifications and substitutions to the specific embodiments disclosed herein. Such modifications and substitutions are within the scope and intent of the present invention as defined in the following claims.

What is claimed is:

1. A turbocharger having variable turbine nozzle geometry, comprising:

a turbine wheel mounted on one end of a shaft for rotation therewith about a rotation axis of the shaft;

a compressor wheel mounted on an opposite end of the shaft for rotation therewith and enclosed within a compressor housing defining an air inlet and an outlet volute;

a turbine housing enclosing the turbine wheel and having a volute for receiving exhaust gas from an internal combustion engine, the turbine housing defining a generally annular nozzle leading radially inward from the volute to the turbine wheel, the nozzle having an axial width defined between a first wall relatively closer to the compressor wheel and a second wall axially spaced relatively farther from the compressor wheel, the turbine housing further having a generally cylindrical inner surface spaced radially outwardly of the turbine wheel; and a piston mounted within the turbine housing concentric with the rotation axis so as to be axially slidable relative to the turbine housing for varying a size of a flow passage through the nozzle into the turbine wheel, the piston having a free end defining a free end face generally perpendicular to the rotation axis and facing toward the first wall, the piston having a generally cylindrical outer surface slidably received within the generally cylindrical inner surface of the turbine housing, the piston further comprising a radial projection at the free end, the projection extending to a larger radius than the generally cylindrical outer surface of the piston and abutting the second wall of the turbine housing when the piston is moved in a first axial direction away from the compressor wheel, thereby limiting such axial movement of the piston in said first axial direction.

2. A turbocharger having variable turbine nozzle geometry comprising:

a turbine housing receiving exhaust gas from an exhaust manifold of an internal combustion engine at an inlet and having an exhaust outlet, a compressor housing having an air inlet and a first volute, and a center housing intermediate the turbine housing and compressor housing;

a turbine wheel carried within the turbine housing and extracting energy from the exhaust gas, said turbine wheel connected to a shaft extending from the turbine housing through a shaft bore in the center housing;

a bearing carried in the shaft bore of the center housing, said bearing supporting the shaft for rotational motion;

a compressor impeller connected to the shaft opposite the turbine wheel and enclosed within the compressor housing;

a substantially cylindrical piston, concentric to the turbine wheel and movable parallel to an axis of rotation of the turbine wheel;

means for moving the substantially cylindrical piston from a first position to a second position for varying a size of a flow passage into the turbine wheel; and wherein the substantially cylindrical piston has a thin walled U-shaped cross section forming an outer ring and an inner ring joined by a web, said outer ring closely received in a cylindrical slot in the turbine housing and said inner ring closely engaging an inner circumferential surface of the exhaust outlet, said inner and outer rings acting as a staggered seal.

3. A turbocharger having variable turbine nozzle geometry, comprising:

a turbine wheel mounted on one end of a shaft for rotation therewith about a rotation axis of the shaft;

a compressor wheel mounted on an opposite end of the shaft for rotation therewith and enclosed within a compressor housing defining an air inlet and an outlet volute;

a turbine housing enclosing the turbine wheel and having a volute for receiving exhaust gas from an internal combustion engine, the turbine housing defining a generally annular nozzle leading radially inward from the volute to the turbine wheel, the nozzle having an axial width defined between a first wall relatively closer to the compressor wheel and a second wall axially spaced relatively farther from the compressor wheel;

a plurality of vanes fixedly mounted in the turbine housing, the vanes extending substantially parallel to the rotation axis and extending from the first wall partway across the axial width of the nozzle such that free ends of the vanes are axially spaced from the second wall; and a piston mounted within the turbine housing concentric with the rotation axis so as to be axially slidable relative to the turbine housing between a first position and a second position, the piston having a free end face generally perpendicular to the rotation axis and facing toward the first wall, the piston in said first position having the free end face proximate the free ends of the vanes such that the exhaust gas flowing from the volute into the turbine wheel passes between the first wall and the free end face of the piston and thus is affected by the vanes, the piston in the second position having the free end face axially spaced from the free ends of the vanes such that a fraction of the exhaust gas flowing from the volute into the turbine wheel passes through a vaneless open annulus defined between the free ends of the vanes and the free end face of the piston.

4. A turbocharger as defined in claim 3, wherein the first wall comprises a heat shield mounted in the turbine housing, the vanes being affixed to the heat shield.

5. A turbocharger as defined in claim 3, wherein the piston has a thin walled U-shaped cross section forming an outer ring and an inner ring joined by a web, said outer ring closely received in a cylindrical slot in the turbine housing and said inner ring closely engaging an inner circumferential surface of the exhaust outlet, said inner and outer rings acting as a staggered seal, and said web forming said free end face of the piston that contacts the free ends of the vanes when the piston is in the first position.

* * * * *